US006060425A

United States Patent [19]

Morohoshi et al.

[11] Patent Number: 6,060,425

[45] Date of Patent: May 9, 2000

[54] REVERSIBLE THERMOSENSITIVE RECORDING MATERIAL

[75] Inventors: Kunichika Morohoshi, Numazu; Yoshihiko Hotta, Mishima; Yukio Konagaya, Shimizu-machi; Makoto Kawaguchi, Shizuoka-ken; Fumihito Masubuchi, Numazu; Nobuo Yamada, Numazu; Toru Nogiwa, Numazu, all of Japan

[73] Assignee: Ricoh Company, Ltd., Tokyo, Japan

[21] Appl. No.: 08/379,022

[22] Filed: Jan. 27, 1995

Related U.S. Application Data

[63] Continuation of application No. 08/164,775, Dec. 10, 1993, abandoned, which is a continuation of application No. 07/894,643, Jun. 5, 1992, abandoned.

[30] Foreign Application Priority Data

Jun. 7, 1991 [JP] Japan ..... 3-163857
May 22, 1992 [JP] Japan ..... 4-155838

[51] Int. Cl.[7] ..... B41M 5/00

[52] U.S. Cl. ..... 503/200; 503/201; 503/204

[58] Field of Search ..... 503/200, 204, 503/226, 201

[56] References Cited

U.S. PATENT DOCUMENTS 4,727,055 2/1988 Aoyagi et al. ..... 503/200
5,087,601 2/1992 Hotta et al. ..... 503/200
5,158,926 10/1992 Hotta et al. .
5,219,820 6/1993 Morohoshi et al. .
5,278,128 1/1994 Hotta et al. ..... 503/207

OTHER PUBLICATIONS

Concise Chemical Dictionary, 4th Enlarged Edition, pp 783, 785, Edited by H. Bennett, FAIC, 1986.

*Primary Examiner*—Pamela R. Schwartz
*Attorney, Agent, or Firm*—Oblon, Spivak, McClelland, Maier & Neustadt, P.C.

[57] ABSTRACT

A reversible thermosensitive recording material containing a support which is composed of a first film, an adhesive layer formed on the first film and a second film formed on the adhesive layer, with the adhesive strength between the first film and the second film being 0.5 kgf/25 mm or more in terms of the average tensile load at an angle of 180° measured in accordance with JIS K 6854, and a reversible thermosensitive recording layer formed on the support, capable of reversibly assuming a transparent state and a white opaque state depending on the temperature thereof, which recording layer contains a matrix resin and an organic low-molecular-weight mateiral dispersed in the form of finely-divided particles in the matrix resin.

26 Claims, 5 Drawing Sheets

REVERSIBLE THERMOSENSITIVE RECORDING MATERIAL

This application is a Continuation of application Ser. No. 08/164,775, filed on Dec. 10, 1993, now abandoned, which is a continuation of application Ser. No. 07/894,643, filed Jun. 5, 1992, abandoned.

BACKGROUND OF THE INVENTION

1. Field of the Invention

The present invention relates to a reversible thermosensitive recording material capable of recording and erasing images repeatedly by utilizing the property of reversibly changing the transparency from a transparent state to an opaque state, and vice versa, depending upon the temperature thereof.

2. Discussion of Background

Recently attention has been paid to a reversible thermosensitive recording material capable of temporarily recording images thereon and erasing the same therefrom when such images become unnecessary. As representative examples of this kind of reversible thermosensitive recording material, there are conventionally known reversible thermosensitive recording materials in which an organic low-molecular-weight material such as a higher fatty acid is dispersed in a matrix resin such as vinyl chloride-vinyl acetate copolymer with a glass transition temperature (Tg) of as low as 50° C. or more to less than 80° C., as disclosed in Japanese Laid-Open Patent Applications 54-119377 and 55-154198.

The above-mentioned conventional reversible thermosensitive recording materials have the defect that the recording materials cause a curling problem. More specifically, upon application of heat to the recording material, the material will curl with the thermosensitive recording layer on the inside of the curve while the image formation and erasure are repeatedly carried out by use of a heating means such as a thermal head.

In order to eliminate the above defect, there is a proposal of the formation of a protective layer on the reversible thermosensitive recording layer. This kind of protective layer, which is designed to protect the thermosensitive recording layer from the above-mentioned thermal hysteresis, comprises a silicone rubber or silicone resin (disclosed in Japanese Laid-Open Patent Application 63-221087), a polysiloxane graft polymer (disclosed in Japanese Laid-Open Patent Application 63-317385), or an ultraviolet-curing resin or electron radiation curing resin (disclosed in Japanese Laid-Open Patent Application 2-566).

However, in the case where a thick protective layer is provided on the recording layer, the protective layer and the reversible thermosensitive recording layer tend to shrink because the crosslinking reaction takes place while a coated liquid for the protective layer is dried under the application of heat thereto. For example, even when a reversible thermosensitive recording material employs as a support film a polyethylene terephthalate film with a thickness of 150 $\mu$m or more, the curling problem occurs.

Due to the above-mention ed curling problem, the reversible thermosensitive recording material causes a transporting failure in an information recording apparatus when applied to a magnetic card such as a prepaid card.

By the way, a variety of methods for displaying information on the surface of a card-type reversible thermosensitive recording material are disclosed. For example, as colored portion is provided behind a reversible thermosensitive recording material as described in Japanese Laid-Open Utility Model Application 2-3876, a light reflection layer is provided behind a reversible thermosensitive recording material to improve the image contrast as in Japanese Laid-Open Patent Application 64-14079, and a thin film is provided behind a recording material, with the refractive index of the thin film being different from that of the recording layer as in Japanese Laid-Open Patent Application 2-175280.

However, when the above-mentioned colored portion is directly or indirectly applied to the thermosensitive recording layer, the image contrast obtained on the recording material is low. In addition, the image contrast cannot be sufficiently improved for practical use even by the provision of the above-mentioned light reflection layer or thin film.

In the case where heat energy is applied to the reversible thermosensitive recording material by using a heat-application roller or a heat-pen, with the application of slight pressure thereto, in order to perform recording and erasing operations, the durability of the recording material is not a problem even though the image formation and erasure are repeated. However, when both heat and pressure are applied to the recording material at the same time, for instance, by using a thermal head, the durability of the recording material becomes a problem during the repeated image formation and erasing operations. This is because the matrix resin has poor heat resistance. More specifically, the matrix resin around the particles of the organic low-molecular-weight material in the recording layer is deformed and the particle size of the organic low-molecular-weight material dispersed in the matrix resin is increased during the course of the repeated recording and erasing operations. As a result, the light scattering effect of the recording layer is decreased. As a matter of course, the degree of whiteness of a white opaque portion in the recording layer is also significantly decreased. In the end, the image contrast is disadvantageously lowered.

Further, the thermosensitivity of the conventional recording materials which are reversibly changeable between a transparent state and a milky white opaque state depending upon the temperature thereof is not sufficient for forming an image thereon by the application of a small amount of thermal energy from a thermal head.

SUMMARY OF THE INVENTION

It is therefore an object of the present invention to provide a reversible thermosensitive recording material, which is capable of reversibly changing its transparency from a transparent state to an opaque state, and vice versa, depending upon the temperature thereof, without causing a curling problem, and has an excellent mechanical strength, high image contrast, satisfactory thermosensitivity, and improved durability, even when the image formation and erasure are repeatedly carried out using a heating means such as a thermal head.

This object of the present invention can be achieved by a reversible thermosensitive recording material comprising (i) a support which comprise a first film, an adhesive layer formed on the first film and a second film formed on the adhesive layer, with the adhesive strength between the first film and the second film being 0.5 kgf/25 mm or more, in terms of the average tensile load at an angle of 180° measured in accordance with JIS K 6854, and (ii) a reversible thermosensitive recording layer formed on the support, capable of reversibly assuming a transparent state and a white opaque state depending on the temperature thereof, which recording layer comprises a matrix resin and an organic low-molecular-weight material dispersed in the form of finely-divided particles in the matrix resin.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

The reversible thermosensitive recording material of the present invention can be switched from a transparent state to a milky white opaque state, and vice versa, depending on the temperature thereof. The difference between the transparent state and the milky white opaque state of the recording material is considered to be based on the following principle:

(i) In the transparent state, the organic low-molecular-weight material dispersed in the matrix resin consists of relatively large crystals, so that the light which enters the crystals from one side passes therethrough to the opposite side, without being scattered, thus the reversible thermosensitive recording material appears transparent.

(ii) In the milky white opaque state, the organic low-molecular-weight material is composed of polycrystals consisting of numerous small crystals, with the crystallographic axes pointed to various directions, so that the light which enters the recording layer is scattered a number of times at the interfaces of the crystals of the low-molecular-weight material. As a result, the thermosensitive recording layer becomes opaque in a milky white color.

The transition of the state of the reversible thermosensitive recording layer depending on the temperature thereof will now be explained by referring to FIG. 1.

Figure 1:
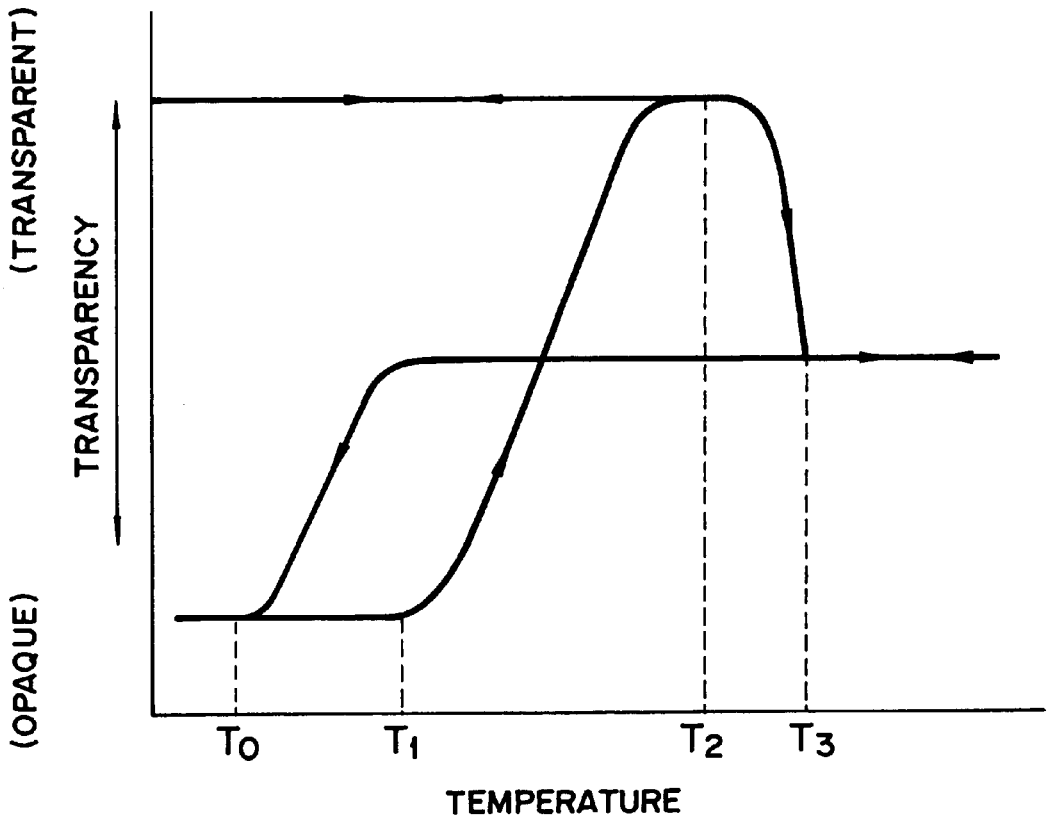
FIG. 1 is a diagram in explanation of the principle of formation and erasure of images in a reversible thermosensitive recording material of the present invention.
Figure 2A:
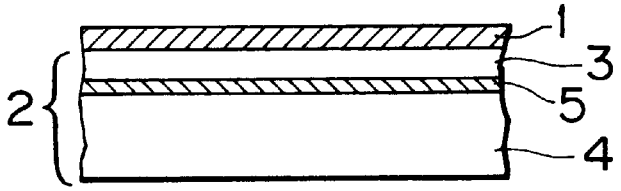
FIGS. 2(*a*) through 2(*d*) are schematic partial cross-sectional views showing one embodiment of a reversible thermosensitive recording material of the present invention.
Figure 2B:
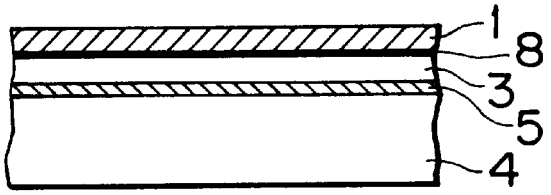
Figure 2C:
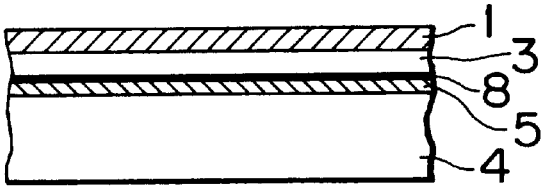
Figure 2D:
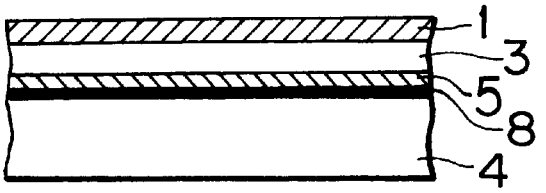
Figure 3A:
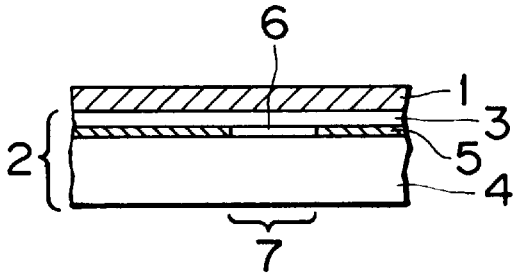
FIGS. 3(*a*) through 3(*e*) are schematic partial cross-sectional views showing the preferred embodiment of a reversible thermosensitive recording material of the present invention wherein an air portion is provided in an adhesive layer.
Figure 3B:
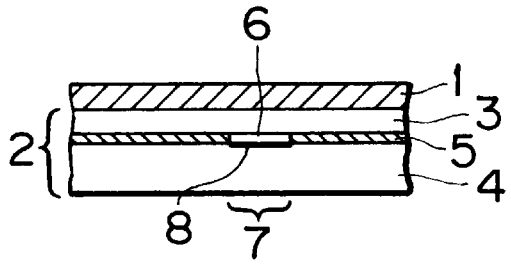
Figure 3C:
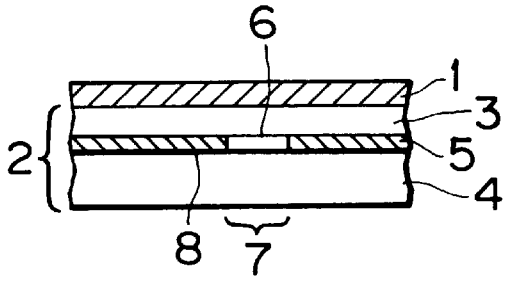
Figure 3D:
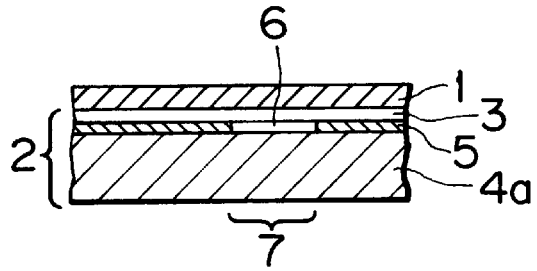
Figure 3E:
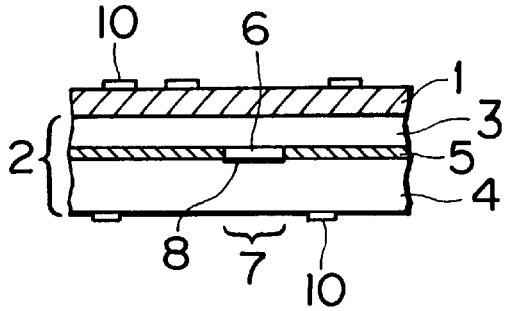
Figure 4A:
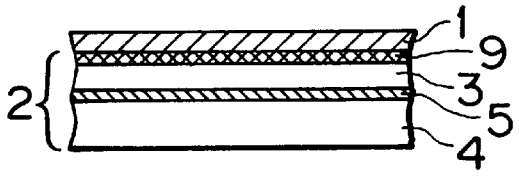
FIGS. 4(*a*) through 4(*e*) are schematic partial cross-sectional views showing the preferred embodiment of a reversible thermosensitive recording material of the present invention in which a magnetic recording layer is additionally provided.
Figure 4B:
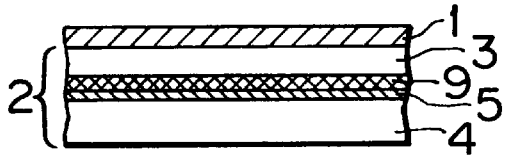
Figure 4C:
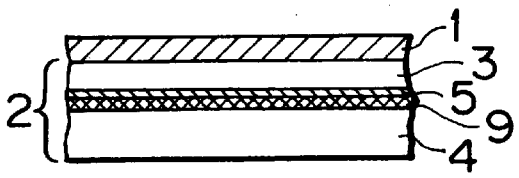
Figure 4D:
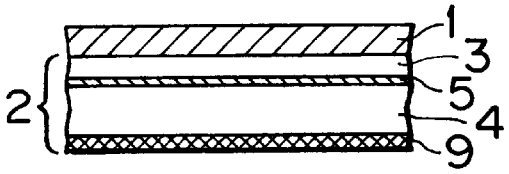
Figure 4E:
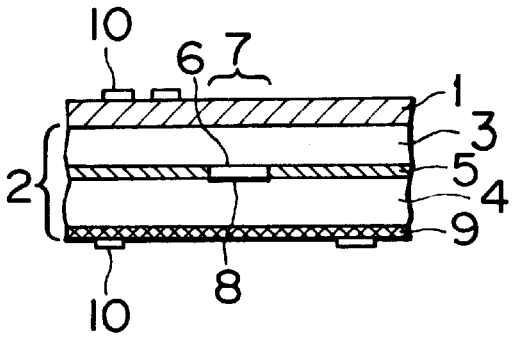
Figure 5A:
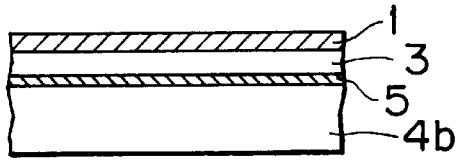
FIGS. 5(*a*) through 5(*d*) are schematic partial cross-sectional views showing the preferred embodiment of a reversible thermosensitive recording material of the present invention in which a first film functions as an IC card by carrying semiconductor device thereon.
Figure 5B:
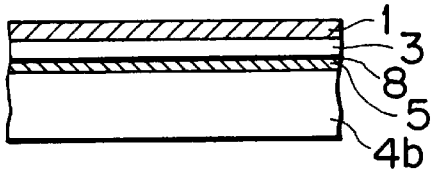
Figure 5C:
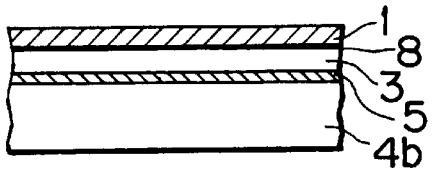
Figure 5D:
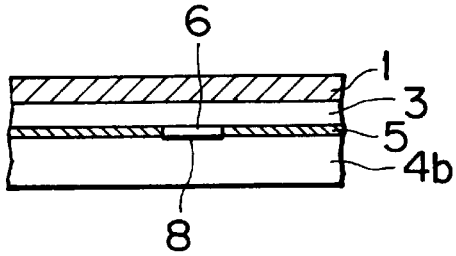

In FIG. 1, it is supposed that the reversible thermosensitive recording material comprising a matrix resin and a low-molecular-weight material dispersed in the matrix resin is initially in a milky white opaque state at room temperature $T_0$ or below. When the recording material is heated to temperature $T_2$, the recording material becomes transparent. Thus, the recording material reaches a maximum transparent state at temperature $T_2$. Even if the recording material which is already in the maximum transparent state is cooled to room temperature $T_0$ or below, the maximum transparent state is maintained. It is considered that this is because the organic low-molecular-weight material changes its state from a polycrystalline state to a single crystalline state via a semi-melted state during the above-mentioned heating and cooling steps.

When the recording material in the maximum transparent state is further heated to temperature $T_3$ or more, it assumes a medium state which is between the maximum transparent state and the maximum milky white opaque state. When the recording material in the medium state at temperature $T_3$ or more is cooled to room temperature $T_0$ or below, the recording material returns to the original maximum opaque state, without passing through any transparent state. It is considered that this is because the organic low-molecular-weight material is melted when heated to temperature $T_3$ or above, and the polycrystals of the organic low-molecular-weight material grow and separate out when it is cooled. If the recording material in the milky white opaque state is heated to any temperature between temperature $T_1$ and temperature $T_2$, and then cooled to the room temperature $T_0$ or below, the recording material assumes an intermediate state between the transparent state and the milky white opaque state.

When the recording material in the transparent state at room temperature $T_0$ is again heated to temperature $T_3$ or above, and then cooled to room temperature $T_0$, the recording material returns to the milky white opaque state. Thus, the reversible thermosensitive recording material according to the present invention can assume a milky white maximum opaque state, a maximum transparent state and an intermediate state between the aforementioned two states at room temperature.

Therefore, a milky white opaque image can be obtained on a transparent background, or a transparent image can also be obtained on a milky white opaque background by selectively applying the thermal energy to the reversible thermosensitive recording material according to the present invention. Further, such image formation and erasure can be repeated many times.

When a colored sheet is placed behind the reversible thermosensitive recording layer of the recording material, the colored image can be obtained on the white opaque background or the white opaque image can be obtained on the colored background.

In the case where the reversible thermosensitive recording material of the present invention is projected using an OHP (Over Head Projector), a milky white opaque portion in the recording material appears dark and a transparent portion in the recording material, through which the light passes becomes a bright portion on the screen.

To record the image on the reversible thermosensitive recording material of the present invention and erase it therefrom, two thermal heads, one for image formation and the other for the image erasure, may be used.

Alternatively, a single thermal head is available if the conditions for applying the heat energy to the recording material can be changed depending on the recording operation and the erasing operation.

In the case where two thermal heads are used, a device for applying the heat energy to the recording material is expensive, however, the image formation and erasure can easily be performed by once causing the recording material to pass through the two thermal heads from which the different heat energy is separately applied to the recording material corresponding to the image formation and image erasure. On the other hand, in the case where a single thermal head is used for both image formation and erasure, the cost of the above-mentioned device is low, but the operation becomes complicated. More specifically, it is necessary to delicately change the heat application conditions of the single thermal head corresponding to a portion where an image is to be recorded or erased while the recording material is caused to pass through the single thermal head at one operation. Or the images are erased by applying the thermal energy for image erasure to the recording material while the recording material is first caused to pass through the single thermal head. Then, when the recording material is caused to reversibly pass through the single thermal head, the images are recorded by the application of the thermal energy for image formation to the recording material.

To form the reversible thermosensitive recording layer on the support, (1) a solution in which both the matrix resin and the organic low-molecular-weight material are dissolved, or (2) a dispersion prepared by dispersing the finely-divided particles of the organic low-molecular-weight material in a matrix resin solution may be coated on the support such as a plastic film or a glass plate, then dried, so that the reversible thermosensitive recording layer can be formed on the support. The aforementioned matrix resin dispersion of the low-molecular-weight material (2) employs a solvent in which at least one of the low-molecular-weight materials can not be dissolved.

The solvent used for the formation of the thermosensitive recording layer can be selected depending on the kind of the matrix resin and the type of the organic low-molecular-weight material to be employed. For example, the solvents such as tetrahydrofuran, methyl ethyl ketone, methyl isobutyl ketone, chloroform, carbon tetrachloride, ethanol, toluene and benzene can be employed. Not only when a matrix resin dispersion is used, but also when a matrix resin solution is used, the organic low-molecular-weight material is separated in the form of finely-divided particles in the matrix resin of the thermosensitive recording layer.

It is preferable that resins for use in the matrix resin of the reversible thermosensitive layer for use in the present invention have excellent film-forming properties, high transparency and high mechanical stability. Examples of such resins include polyvinyl chloride resin; vinyl chloride copolymers such as polyvinyl chloride-vinyl acetate copolymer, vinyl chloride-vinyl acetate-vinyl alcohol copolymer, vinyl chloride-vinyl acetate-maleic acid copolymer and vinyl chloride-vinyl acrylate copolymer; vinylidene chloride copolymers such as polyvinylidene chloride, vinylidene chloride-vinyl chloride copolymer, vinylidene chloride-acrylonitrile copolymer; polyester; polyamide; polyacrylate, polymethacrylate or acrylate-methacrylate copolymer; and silicone resin. These resins can be used alone or in combination.

The organic low-molecular-weight material for use in the reversible thermosensitive recording layer may be appropriately selected from the materials which are changeable from the polycrystalline state to the single crystalline state in accordance with each of the desired temperatures ranging from $T_0$ to $T_3$ as shown in FIG. 1. It is preferable that the organic low-molecular-weight material for use in the present invention have a melting point ranging from 30 to 200° C., more preferably from about 50 to 150° C.

Examples of the organic low-molecular-weight material for use in the present invention are alkanols; alkane diols; halogenated alkanols or halogenated alkane diols; alkylamines; alkanes; alkenes; alkynes; halogenated alkanes; halogenated alkenes; halogenated alkynes; cycloalkanes; cycloalkenes; cycloalkynes; saturated or unsaturated monocarboxylic acids, or saturated or unsaturated dicarboxylic acids, and esters, amides and ammonium salts thereof; saturated or unsaturated halogenated fatty acids; and esters, amides and ammonium salts thereof; arylcarboxylic acids, and esters, amides and ammonium salts thereof; halogenated arylcarboxylic acids, and esters, amides and ammonium salts thereof; thioalcohols; thiocarboxylic acids, and esters, amides and ammonium salts thereof; and carboxylic acid esters of thioalcohol. These materials can be used alone or in combination.

It is preferable that the number of carbon atoms of the above-mentioned low-molecular-weight material be in the range of 10 to 60, more preferably in the range of 10 to 38, further preferably in the range of 10 to 30. Part of the alcohol groups in the esters may be saturated or unsaturated, and further may be substituted by halogen. In any case, it is preferable that the organic low-molecular-weight material have at least one atom selected from the group consisting of oxygen, nitrogen, sulfur and halogen in its molecule. More specifically, it is preferable the organic low-molecular-weight materials comprise, for instance, —OH, —COOH, —CONH, —COOR, —NH, —$NH_2$, —S—, —S—S—, —O— or a halogen atom.

Specific examples of the above-mentioned organic low-molecular-weight materials include higher fatty acids such as lauric acid, dodecanoic acid, myristic acid, pentadecanoic acid, palmitic acid, stearic acid, behenic acid, nonadecanoic acid, arachic acid, heneicosanoic acid, tricosanoic acid, lignoceric acid, pentacosanoic acid, cerotic acid, heptacosanoic acid, montanic acid, melissic acid, oleic acid; esters of higher fatty acids such as methyl stearate, tetradecyl stearate, octadecyl stearate, octadecyl laurate, tetradecyl palmitate and dodecyl behenate; and the following ethers or thioethers:

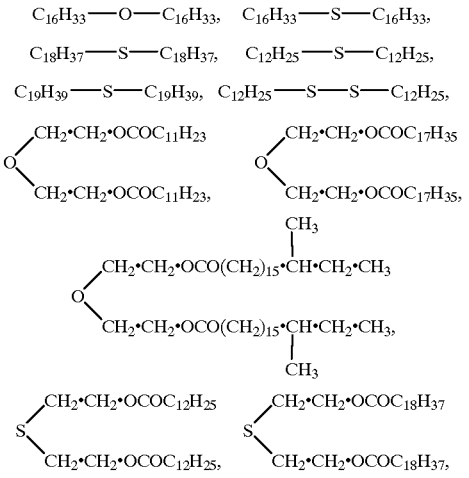

-continued

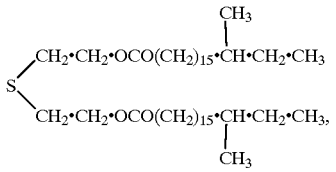

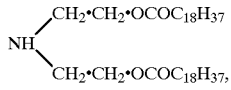

and

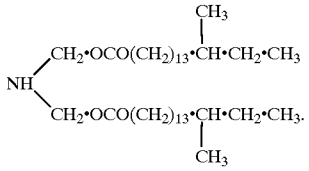

Of these, higher fatty acids having 16 or more carbon atoms, more preferably having 16 to 24 carbon atoms, such as palmitic acid, pentadecanoic acid, nonadecanoic acid, arachic acid, heneicosanoic acid, tricosanoic acid, lignoceric acid, stearic acid and behenic acid are preferred in the present invention.

Furthermore, it is possible to employ one of the previously mentioned organic low-molecular-weight materials, and another as a crystal growth controlling agent in combination. For instance, when stearic acid is employed as the organic low-molecular-weight material, stearyl alcohol can be used as a material for controlling the crystal growth.

It is preferable that the ratio by weight of the organic low-molecular-weight material to the material for controlling the crystal growth of the organic low-molecular-weight material be in the range of (1:0.1) to (1:0.8).

When the weight ratio of the organic low-molecular-weight material to the material for controlling the crystal growth of the organic low-molecular-weight material is within the above range, the temperature range in which the reversible thermosensitive recording material can assume a transparent state is sufficiently increased, an the white opaque degree in a white opaque state is not decreased.

It is preferable that the ratio by weight of the organic low-molecular-weight material to the matrix resin be in the range of about (2:1) to (1:16), more preferably in the range of (1:1) to (1:8) in the reversible thermosensitive recording layer. When the ratio of the low-molecular-weight material to the matrix resin is within the above range, the matrix resin can form a film in which the organic low-molecular-weight material is uniformly dispersed in the form of finely-divided particles, and the obtained recording layer can readily reach the maximum white opaque state.

It is preferable that the reversible thermosensitive recording layer have a thickness of 1 to 30 $\mu$m, more preferably a thickness of 2 to 20 $\mu$m, in order to make the temperature distribution of the reversible thermosensitive recording layer uniform, and to obtain a uniform transparent state and a white opaque state with high contrast. The degree of the white opaqueness can be increased by increasing the amount of the organic low-molecular-weight material in the thermosensitive recording layer.

In the reversible thermosensitive recording layer for use in the present invention, additives such as a surface-active agent and a high-boiling point solvent can be employed to facilitate the formation of a transparent image.

Examples of the high-boiling point solvent are tributyl phosphate, tri-2-ethylhexyl phosphate, triphenyl phosphate, tricresyl phosphate, butyl oleate, dimethyl phthalate, diethyl phthalate, dibutyl phthalate, diheptyl phthalate, di-n-octyl phthalate, di-2-ethylhexyl phthalate, diisononyl phthalate, dioctyldecyl phthalate, diisodecyl phthalate, butylbenzyl phthalate, dibutyl adipate, di-n-hexyl adipate, di-2-ethylhexyl adipate, di-2-ethylhexyl azelate, dibutyl sebacate, di-2-ethylhexyl sebacate, diethylene glycol dibenzoate, triethylene glycol, di-2-ethyl butyrate, methyl acetylricinoleate, butyl acetylricinoleate, butylphthalyl butyl glycolate and tributyl acetylcitrate.

Examples of the surface-active agent are polyhydric alcohol higher fatty acid esters; polyhydric alcohol higher alkyl ethers; lower olefin oxide adducts of polyhydric alcohol higher fatty acid ester, higher alcohol, higher alkylphenol, higher alkylamine of higher fatty acid, amides of higher fatty acid, fat and oil and polypropylene glycol; acetylene glycol; sodium, calcium, barium and magnesium salts of higher alkyl benzenesulfonic acid; calcium, barium and magnesium salts of higher fatty acid, aromatic carboxylic acid, higher aliphatic sulfonic acid, aromatic sulfonic acid, sulfuric monoester, phosphoric monoester and phosphoric diester; lower sulfated oil; long-chain polyalkyl acrylate; acrylic oligomer; long-chain polyalkyl methacrylate; long-chain alkyl methacrylate-amine-containing monomer copolymer; styrene-maleic anhydride copolymer; and olefin-maleic anhydride copolymer.

A protective layer may be formed on the reversible thermosensitive recording layer in order to prevent the thermosensitive recording layer from being deformed by the heat and pressure applied by a thermal head and from the the transparency of the transparent portion thereof being decreased by such deformation. It is preferable that the protective layer have a thickness in the range of 1.0 $\mu$m to 15 $\mu$m, more preferably in the range of about 2 to 10 $\mu$m. As the material for the protective layer, silicone rubber, silicone resin (described in Japanese Laid-Open Patent Application 63-221087), polysiloxane graft polymer (described in Japanese Laid-Open Patent Application 63-317385), ultraviolet-curing resin and electron radiation curing resin (described in Japanese Laid-Open Patent Application 2-566) can be employed. In any case, the material for the protective layer is dissolved in a solvent to prepare a coating liquid and the thus prepared coating liquid is coated on the thermosensitive recording layer. Thus it is desirable that the resin and the organic low-molecular-weight material for use in the thermosensitive recording layer be not easily dissolved in such a solvent for use in the protective layer.

Examples of the above-mentioned solvent in which the resin and the organic low-molecular-weight material for use in the thermosensitive recording layer are not easily dissolved include n-hexane, methyl alcohol, ethyl alcohol and isopropyl alcohol. In particular, alcohol-based solvents are preferred from the viewpoint of the cost.

Further, an intermediate layer can be interposed between the protective layer and the thermosensitive recording layer to protect the thermosensitive recording layer from the solvent or a monomer component for the protective layer formation liquid (Japanese Laid-Open Patent Application 1-133781).

Examples of the resin for use in the formation of the intermediate layer include the resins used as the matrix resin for the thermosensitive recording layer, and the following thermosetting resins and thermoplastic resins: polyethylene, polypropylene, polystyrene, polyvinyl alcohol, polyvinyl butyral, polyurethane, saturated polyester, unsaturated polyester, epoxy resin, phenolic resin, polycarbonate, and polyamide.

It is preferable that the intermediate layer have a thickness of about 0.1 μm to 2 μm to obtain an appropriate protection effect and not to reduce the thermosensitivity of the thermosensitive recording layer.

The present invention will now be explained in detail, referring to FIG. 2 through FIG. 7.

FIG. 2(*a*) shows one embodiment of the reversible thermosensitive recording material of the present invention with a basic structure. In FIG. 2(*a*), the recording material comprises a support 2 and a reversible thermosensitive recording layer 1 provided on the support 2. The support 2, which has a laminated structure, comprises a first film 4, an adhesive layer 5 formed thereon, and a second film 3 on the adhesive layer 5. A light reflection layer 8 may be interposed between the second film 3 and the reversible thermosensitive recording layer 1 as shown in FIG. 2(*b*), between the adhesive layer 5 and the second film 3 as shown in FIG. 2(*c*), or between the first film 4 and the adhesive layer 5 as shown in FIG. 2(*d*).

FIG. 3(*a*) shows another embodiment of the reversible thermosensitive recording material according to the present invention. In the recording material shown in FIG. 3(*a*), corresponding to a display portion 7, there is provided an air-containing vacant portion 6 (hereinafter referred to as an air portion 6) in an adhesive layer 5, in which a first film is out of contact with a second film. Namely, a second film 3 is provided over a first film 4 with the air portion 6 interposed therebetween.

In such a structure the image contrast obtained on the display portion 7 can be improved due to the light reflection from the interfaces between the air portion 6 in the adhesive layer 5 and the second film 3.

Figure 6:
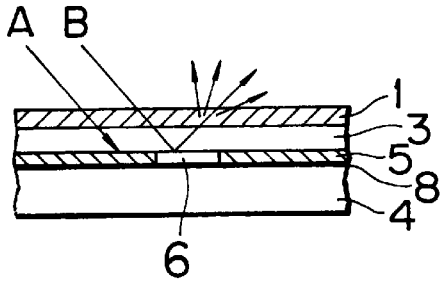
FIG. 6 is a schematic partial cross-sectional view of a reversible thermosensitive recording material of the present invention in explanation of the advantage of the provision of an air portion on the adhesive layer.

The advantage of the reversible thermosensitive recording material according to the present invention wherein the adhesive layer contains an air portion will now be explained in detail with reference to FIG. 6. In this structure shown in FIG. 6, a colored layer 8 is formed between the first film 4 and the adhesive layer 5.

The light A entering the thermosensitive recording layer 1 is caused to pass through the second film 3 and the adhesive layer 5 and absorbed in the colored layer 8. When the light B passing through the second film 3 reaches the air portion 6 of the adhesive layer 5 as shown in FIG. 6, the light B is reflected from the interfaces between the back side of the second film 3, opposite to the side of the recording layer 1, and the air portion 6, so that the whiteness degree of the recording layer 1 in the white opaque state is improved, and the obtained image can be visually identified without difficulty. The above-mentioned phenomenon is caused because of a large difference between the refractive index of the organic low-molecular-weight material employed as the main component in the reversible thermosensitive recording layer 1 ranging from about 1.4 to 1.6 and the refractive index of air contained in the air portion 6 of 1.0. Therefore, it is preferable to form the air portion 6 in the adhesive layer 5 corresponding to a display portion.

Further, the adhesive layer which comprises the air portion containing air therein serves as a heat insulating layer, and the thermosensitivity of the reversible thermosensitive recording material is improved.

Moreover, the air portion plays the role of a cushioning material, so that the pressure substantially applied to the thermosensitive recording material can be reduced even though the pressure is applied to the recording material by a thermal head. For this reason mentioned above, the matrix resin in the thermosensitive recording layer is scarcely deformed, and the particle size of the organic low-molecular-weight material do not grow. As a result, the durability of the recording material is improved even when the image formation and the erasure are repeatedly performed under the application of the heat energy.

The reversible thermosensitive recording materials according to the present invention with the above described structures do not cause the curling problem due to the shrinkage of the thermosensitive recording layer. The shrinkage of the recording layer results from the crosslinking reaction which takes place in the recording layer when a coated liquid for a protective layer is dried under application of heat, and the thermal hysteresis applied to the recording layer during the image formation and erasure by use of the thermal head. Although the reason for preventing the curling problem is not clarified, it is considered that the adhesive layer interposed between the first film and the second film sufficiently works to release the stress applied to the recording material when compared with the conventional recording material which employs a single-layered film as a support.

Examples of the material for the first film and the second film constituting the support for the reversible thermosensitive recording material according to the present invention include plastic films such as polyethylene, polypropylene, polyvinyl chloride, polyvinylidene chloride, polyvinyl alcohol, polyethylene terephthalate, polycarbonate, nylon, polystyrene, ethylene-vinyl acetate copolymer, ethylene-vinyl alcohol copolymer, polyethylene naphthalate, fluorinated ethylene propylene, aromatic polyamide, polyarylate, polyether sulfone, polyether imide, polyimide, acrylic resin, and ionomer.

In the thermosensitive recording material of the present invention, the support 2 comprises the two sheets of film, with the adhesive layer interposed therebetween. The materials for the first film and the second film may be the same or different, and it is preferable that the thickness of each film be in the range of about 4 to 350 μm.

In the adhesive layer of the reversible thermosensitive recording material according to the present invention, any conventional adhesive agent can be employed. For example, an adhesive agent which comprises at least one component selected from the group consisting of urea resin, melamine resin, phenolic resin, epoxy resin, vinyl acetate resin, vinyl acetate-acrylic copolymer resin, ethylene-vinyl acetate copolymer resin, acrylic resin, polyvinyl ether resin, vinyl chloride-vinyl acetate copolymer resin, polystyrene resin, polyester resin, polyurethane resin, polyamide resin, chlorinated polyolefin resin, polyvinyl butyral resin, acrylate copolymer resin, methacrylate copolymer resin, natural rubber, cyanoacrylate resin and silicone resin can be employed. A tackifier appropriate for the employed adhesive agent may be contained in the adhesive layer.

Furthermore, the adhesive layer may further comprise a plasticizer, a filler and an aging prevention agent, when necessary.

To prepare the adhesive layer for use in the present invention, the viscosity of the adhesive agent is controlled by the addition of water or organic solvent thereto, and the adhesive agent is coated on the first film in accordance with the conventional coating method. Subsequently, the second film is overlaid on the adhesive layer. It is preferable that the thickness of the adhesive layer be in the range of about 1 to 40 μm.

When the image formation and the erasure are performed on the reversible thermosensitive recording material according to the present invention, the recording material is transported between the thermal head and the platen roller under the application of pressure, so that the shearing stress is generated in the recording material. In particular, the shearing stress is strongly applied to the most weak portion of the recording material, that is, the two films laminated with the adhesive layer in the present invention.

Moreover, while the recording material is transported rolled around a platen roller or caused to bend along a transporting guide in an image recording apparatus, the bending stress is applied to the recording material.

With the above-mentioned facts taken into consideration, in the recording material of the present invention, the adhesive strength between the first film and the second film is 0.5 kgf/25 mm or more in terms of the average tensile load at an angle of 180° measured in accordance with JIS K 6854, more preferably 1.0 kgf/25 mm or more, and further preferably 2.0 kgf/25 mm or more. When the adhesive strength between the first film and the second film is 0.5 kgf/25 mm or more, the first film can be prevented from slipping or peeling off the second film even when the image formation and the erasure are repeated by use of a thermal head.

In the case where the adhesive layer of the recording material comprises an air portion as shown in FIG. 3, the stress is particularly concentrated at the boundary between the air portion and the portion filled with the adhesive agent in the adhesive layer. When the adhesive strength between the first film and the second film is 0.5 kgf/25 mm or more in terms of the average tensile load at an angle of 180° measured in accordance with JIS K 6854, the second film provided on the adhesive layer comprising an air portion can be prevented from peeling off the first film likewise.

In FIG. 3(*a*), an adhesive layer 5 interposed between a first film 4 and a second film 3 contains therein an air portion 6 corresponding to a display portion 7 on the first film 4 for the purpose of more readily identifying the obtained image. In such a structure as shown in FIG. 3(*a*), a light reflection layer or colored layer 8 can be provided as shown in FIG. 3(*b*) and FIG. 3(*c*).

In this case, the light reflection layer or colored layer 8 may be formed on the first film 4 only in the portion corresponding to the air portion 6 of the adhesive layer 5 as shown in FIG. 3(*b*), or on the entire surface of the first film 4 as shown in FIG. 3(*c*). Moreover, FIG. 3(*d*) shows an embodiment of the recording material according to the present invention in which a colored first film 4*a* is employed.

The light reflection layer for use in the present invention can be prepared by deposition of a metal such as aluminum, nickel or tin on the first or second film in accordance with the method as described in Japanese Laid-Open Patent Application 64-14079.

The previously mentioned colored layer for use in the present invention can be prepared by coating or printing any color such as black, blue, green or red on the first or second film. Alternatively, a colored sheet of paper or film can be used as the first film as shown in FIG. 3(*d*).

FIG. 3(*e*) shows an embodiment of the reversible thermosensitive recording material when applied to a card for practical use. Images 10 such as a picture and a character can be printed on one side of the first film 4, opposite to the adhesive layer 5, and/or on one side of the recording layer 1, opposite to the second film 3.

In addition, the reversible thermosensitive recording material according to the present invention can be applied to a magnetic card by provision of a magnetic recording layer 9 between the second film 3 and the reversible thermosensitive recording layer 1 as shown in FIG. 4(*a*), between the adhesive layer 5 and the second film 3 as shown in FIG. 4(*b*), between the first film 4 and the adhesive layer 5 as shown in FIG. 4(*c*), or behind the first film 4 as shown in FIG. 4(*d*). FIG. 4(*e*) shows an embodiment of the reversible thermosensitive recording material according to the present invention when applied to a magnetic card for practical use. In this structure as shown in FIG. 4(*e*), there is an air portion 6 in an adhesive layer 5, corresponding to a display portion 7 on the surface of a reversible thermosensitive recording layer 1. Moreover, a magnetic recording layer 9 is provided behind a first film 4, with a picture or character 10 printed on the surface of the thermosensitive recording layer 1 and that of the magnetic recording layer 9. By use of this type of reversible thermosensitive recording material, magnetic recording is possible. The magnetic recording layer for use in the present invention can be provided by the conventional method.

In the present invention, both the first film and the second film may be transparent. Alternatively, the opaque magnetic recording layer or light reflection layer may be attached to the first or second film, or the colored film may be employed, as previously explained. In the case where the magnetic recording layer or light reflection layer in an opaque color is attached to one of the two films, the other film does not have to be opaque. Further when one of the two films is colored, with the density measured by Macbeth densitometer being as high as 1.0 or more, the other film does not have to be opaque.

In the case of the recording material with the structure as shown in FIG. 2(*c*) or 2(*d*), it is preferable that the second film 3 have a visible light transmission of 50% or more. When the adhesive layer of reversible thermosensitive recording material comprises an air portion as shown in FIGS. 3(*a*) through 3(*e*), the second film with a visible light transmission of 50% or more is preferably employed. In this case, a conventionally used film, for example, a sheet of paper, or a film of a plastic material such as polyester, vinyl chloride, acrylic resin, polyethylene, or vinylidene chloride may be used as a second film.

Figure 7:
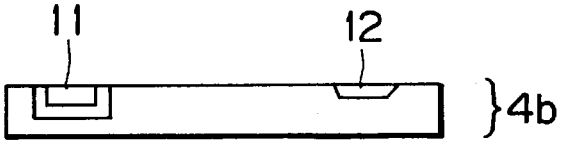
FIG. 7 is a schematic cross-sectional view of a first film of a reversible thermosensitive recording material according to the present invention when applied to an IC card.

FIG. 5(*a*) shows another embodiment of a reversible thermosensitive recording material according to the present invention. This recording material comprises a first film 4*b* which is modified to function as an information-carrying-member such as an IC card in such a fashion that the first film 4*b* further comprises a semiconductor device. More specifically, the recording material of the present invention can be applied to an IC card with a built-in microprocessor of contact or non-contact type, or a memory card with a memory module by mounting on the first film 4*b* an IC module 11 and an electrode 12 as shown in FIG. 7.

The light reflection layer or colored layer 8 can be interposed between the adhesive layer 5 and the second film 3 as shown in FIG. 5(*b*), or between the second film 3 and the reversible thermosensitive recording layer 1 as shown in FIG. 5(*c*). Alternatively, a light reflection portion or colored portion 8 may be formed on the first film 4*b* only in the area corresponding to the air portion 6 of the adhesive layer 5 as shown in FIG. 5(*d*).

Other features of this invention will become apparent in the course of the following description of exemplary embodiments which are given for illustration of the invention and are not intended to be limiting thereof.

EXAMPLE 1

[Formation of Light Reflection Layer]

Aluminum was vacuum-deposited on a polyethylene terephthalate (PET) film with a thickness of 50 $\mu$m, serving as a second film, so that a light reflection layer with a thickness of about 400 Å was formed on the second film.

[Formation of Reversible Thermosensitive Recording Layer]

The following components were mixed to prepare a reversible thermosensitive recording layer coating liquid:

| | Parts by Weight |
|---|---|
| Stearic acid | 6 |
| Eicosanedioic acid | 4 |
| Diisodecyl phthalate | 2 |
| Vinyl chloride-vinyl acetate-phosphoric ester copolymer (Trademark "Denka Vinyl #1000P", made by Denki Kagaku Kogyo K.K.) | 20 |
| Tetrahydrofuran | 150 |
| Toluene | 15 |

The above prepared reversible thermosensitive recording layer coating liquid was coated on the above-prepared light reflection layer and dried under application of heat thereto, so that a reversible thermosensitive recording layer with a thickness of about 5 μm was formed on the light reflection layer.

[Formation of Intermediate Layer]

The following components were mixed to prepare an intermediate layer coating liquid:

| | Parts by Weight |
|---|---|
| Polyamide resin (Trademark "CM8000", made by Toray Industries Inc.) | 5 |
| Methyl alcohol | 90 |

The above prepared intermediate layer coating liquid was coated on the above-prepared reversible thermosensitive recording layer by a wire bar and dried under application of heat thereto, so that an intermediate layer with a thickness of about 0.3 μm was formed on the reversible thermosensitive recording layer.

[Formation of Protective Layer]

Butyl acetate solution of urethane-acrylate based ultraviolet-curing resin "Unidic C7-157" (Trademark), made by Dainippon Ink & Chemicals, Incorporated was coated on the above-prepared intermediate layer by a wire bar, dried under application of heat thereto, and exposed to an ultraviolet lamp of 80 W/cm for three seconds, so that a protective layer with a thickness of about 3 μm was formed on the intermediate layer.

[Formation of Adhesive Layer]

The following components were mixed to prepare an adhesive layer coating liquid:

| | Parts by Weight |
|---|---|
| Epoxy-based adhesive agent (Trademark "EPU-6", made by Asahi Denka Kogyo K.K.) | 20 |
| Triethylenetetramide (made by Asahi Denka Kogyo K.K.) | 2 |

The above prepared adhesive layer coating liquid was coated on a PET film with a thickness of 200 μm, serving as a first film. The thus prepared adhesive layer on the first film was caused to adhere to one side of the second film, opposite to the light reflection layer side, and cured at 50° C. for one week, so that an adhesive layer with a thickness of about 30 μm was formed between the first film and the second film. Thus, a reversible thermosensitive recording material No. 1 according to the present invention was prepared.

EXAMPLE 2

The procedure for preparation of the reversible thermosensitive recording material No. 1 in Example 1 was repeated except that a mixture of 20 parts of "EPU-6" and 2 parts of "triethylenetetramine" (Trademark), made by Asahi Denka Kogyo K. K. was replaced by the commercially available nitrile rubber-based adhesive agent "EC776" (Trademark), made by Sumitomo 3M Limited, and that the thickness of the adhesive layer was changed to about 40 μm, so that a reversible thermosensitive recording material No. 2 according to the present invention was prepared.

EXAMPLE 3

[Formation of Light Reflection Layer]

Aluminum was vacuum-deposited on a polyethylene terephthalate (PET) film with a thickness of 50 μm, serving as a second film, so that a light reflection layer with a thickness of about 400 Å was formed on the second film.

[Formation of Reversible Thermosensitive Recording Layer]

The following components were mixed to prepare a reversible thermosensitive recording layer coating liquid:

| | Parts by Weight |
|---|---|
| Stearic acid | 6 |
| Eicosanedioic acid | 4 |
| Diisodecyl phthalate | 2 |
| Vinyl chloride-vinyl acetate-phosphoric ester copolymer (Trademark "Denka Vinyl #1000P", made by Denki Kagaku Kogyo K.K.) | 20 |
| Tetrahydrofuran | 150 |
| Toluene | 15 |

The above prepared reversible thermosensitive recording layer coating liquid was coated on the above-prepared light reflection layer and dried under application of heat thereto, so that a reversible thermosensitive recording layer with a thickness of about 5 μm was formed on the light reflection layer.

[Formation of Intermediate Layer]

The following components were mixed to prepare an intermediate layer coating liquid:

| | Parts by Weight |
|---|---|
| Polyamide resin (Trademark "CM8000", made by Toray Industries Inc.) | 5 |
| Methyl alcohol | 90 |

The above prepared intermediate layer coating liquid was coated on the above-prepared reversible thermosensitive recording layer by a wire bar and dried under application of heat thereto, so that an intermediate layer with a thickness of about 0.3 μm was formed on the reversible thermosensitive recording layer.

[Formation of Protective Layer]

Butyl acetate solution of urethane-acrylate based ultraviolet-curing resin "Unidic C7-157" (Trademark), made by Dainippon Ink & Chemicals, Incorporated was coated on the above-prepared intermediate layer by a wire bar, dried under application of heat thereto, and exposed to an ultraviolet lamp of 80 W/cm for three seconds, so that a protective layer with a thickness of about 3 μm was formed on the intermediate layer.

[Formation of Adhesive Layer]

A black color portion was printed at the center of a white PET film with a thickness of 188 μm, serving as a first film. The commercially available nitrile rubber-based adhesive agent "EC776" (Trademark), made by Sumitomo 3M Limited, was applied to the first film except the black color portion thereon, so that an adhesive layer with a thickness of about 40 μm was prepared in such a fashion that an air portion was located in the adhesive layer corresponding to the black color portion of the first film.

The second film on which the light reflection layer, the reversible thermosensitive recording layer, the intermediate layer and the protective layer successively overlaid in this order was caused to attach to the above prepared adhesive layer, whereby a reversible thermosensitive recording material No. 3 according to the present invention was prepared.

EXAMPLE 4

The procedure for preparation of the reversible thermosensitive recording material No. 3 in Example 3 was repeated except that the black color portion formed on the first film by printing in Example 3 was replaced by a light reflection portion thereon by aluminum-deposition and that a magnetic recording layer was additionally formed behind the first film by the conventional method, whereby a reversible thermosensitive recording material No. 4 according to the present invention was prepared.

EXAMPLE 5

The procedure for preparation of the reversible thermosensitive recording material No. 1 in Example 1 was repeated except that the commercially available epoxy-based adhesive agent "EPU-6" (Trademark), made by Asahi Chemical Industry Co., Ltd. was replaced by "EPU-4100" (Trademark), made by Asahi Chemical Industry Co., Ltd., for use in the adhesive layer, whereby a reversible thermosensitive recording material No. 5 according to the present invention was prepared.

EXAMPLE 6

The same procedure for preparation of the light reflection layer, the reversible thermosensitive recording layer, the intermediate layer and the protective layer on the second film as in Example 3 was repeated.

An IC card with 8-bit built-in microcomputer, serving as a first film, was partially printed in black. The commercially available nitrile rubber-based adhesive agent "EC776" (Trademark), made by Sumitomo 3M Co., Ltd., was applied to the IC card except the black portions thereon, so that an adhesive layer was formed on the IC card in such a fashion that the air portion were located in the adhesive layer corresponding to the black color portions of the IC card. Thus, a reversible thermosensitive recording material No. 6 according to the present invention was prepared.

COMPARATIVE EXAMPLE 1

The same procedure for preparation of the light reflection layer, the reversible thermosensitive recording layer, the intermediate layer and the protective layer on the second film as in Example 3 was repeated.

The thus obtained adhesive layer was caused to adhere to one side of the second film, opposite to the reversible thermosensitive recording layer side, whereby a comparative reversible thermosensitive recording material No. 1 was prepared.

COMPARATIVE EXAMPLE 2

The procedure for preparation of the comparative reversible thermosensitive recording material No. 1 in Comparative Example 1 was repeated except that the adhesive agent "S-dain AE-206" (Trademark), made by Sekisui S-dain Co., Ltd., was replaced by the commercially available silicone-based pressure-sensitive adhesive "Trefirm SD4570" (Trademark), made by Dow Corning Toray Silicone Co., Ltd., and that the thickness of the adhesive layer was changed to 30 μm, whereby a comparative reversible thermosensitive recording material No. 2 was prepared.

COMPARATIVE EXAMPLE 3

[Formation of Reversible Thermosensitive Recording Layer]

The following components were mixed to prepare a reversible thermosensitive recording layer coating liquid:

| | Parts by Weight |
|---|---|
| Stearic acid | 6 |
| Eicosanedioic acid | 4 |
| Diisodecyl phthalate | 2 |
| Vinyl chloride-vinyl acetate-phosphoric ester copolymer (Trademark "Denka Vinyl #1000P", made by Denki Kagaku Kogyo K.K.) | 20 |
| Tetrahydrofuran | 150 |
| Toluene | 15 |

The above prepared reversible thermosensitive recording layer coating liquid was coated on a PET film with a thickness of 250 μm, serving as a support, and dried, so that a reversible thermosensitive recording layer with a thickness of about 5 μm was formed on the support.

[Formation of Intermediate Layer]

The following components were mixed to prepare an intermediate layer coating liquid:

| | Parts by Weight |
|---|---|
| Polyamide resin (Trademark "CM8000", made by Toray Industries Inc.) | 5 |
| Methyl alcohol | 90 |

The above prepared intermediate layer coating liquid was coated on the above-prepared reversible thermosensitive recording layer by a wire bar and dried under application of heat thereto, so that an intermediate layer with a thickness of about 0.3 μm was formed on the reversible thermosensitive recording layer.

[Formation of Protective Layer]

Butyl acetate solution of urethane-acrylate based ultraviolet-curing resin "Unidic C7-157" (Trademark), made by Dainippon Ink & Chemicals, Incorporated was coated on the above-prepared intermediate layer by a wire bar, dried under application of heat thereto, and exposed to an ultraviolet lamp of 80 W/cm for three seconds, so that a protective layer with a thickness of about 3 μm was formed on the intermediate layer. Thus, a comparative reversible thermosensitive recording material No. 3 was prepared.

The above prepared reversible thermosensitive recording materials No. 1 to No. 6 according to the present invention obtained in Examples 1 to 6 and the comparative reversible thermosensitive recording materials No. 1 to No. 3 obtained in Comparative Examples 1 to 3 were inspected with respect to the curling problem.

Specifically, each recording material was formed into a card measuring 5.8 by 8.8 cm after preparation. Each recording material in card form was put on an even surface of a desk, and the distance A between the surface of the desk and the curled end portion of the card-shaped recording material was measured.

The curling degree was evaluated in accordance with the following scale:

Distance A of more than 3 mm . . . x

Distance A of 1 to 3 mm . . . Δ

Distance A of less than 1 mm . . . o

The results are shown in Table 1.

TABLE 1

| | Curling Degree after preparation |
|---|---|
| Example 1 | ○ |
| Example 2 | ○ |
| Example 3 | ○ |
| Example 4 | ○ |
| Example 5 | Δ |
| Example 6 | ○ |
| Comparative Example 3 | x |

On the reversible thermosensitive recording materials No. 1 to No. 5 and the comparative reversible thermosensitive recording materials No. 1 to No. 3, the image formation was carried out, with the application of thermal energy of 0.3 mj, followed by the erasure of the obtained image with the application of thermal energy of 0.2 mj for using a recording apparatus having a thermal head with a density of 8 dot/mm (on an experimental basis for card-type material). The cycle of image formation and erasure was repeated in the above-mentioned manner.

In the reversible thermosensitive recording materials No. 1 to No. 5 according to the present invention, the second film was not peeled off the first film even when the 100-cycles of the image formation and erasure were conducted. On the contrary, the second film was peeled off the first film at the 6th cycle in the comparative recording material No. 1, and the 12th cycle in the comparative recording material No. 2.

Further, the adhesive strength between the first film and the second film of the recording materials No. 1 to No. 5 according to the present invention and the comparative recording material No. 1 and No. 2 in terms of the average tensile load at an angle of 180° in accordance with the method described in JIS K 6854 was measured. The results are shown below.

TABLE 2

| | Adhesive Strength |
|---|---|
| Recording Material No. 1 | 1.0 kgf/25 mm |
| Recording Material No. 2 | 1.81 kgf/25 mm |
| Recording Material No. 3 | 1.81 kgf/25 mm |
| Recording Material No. 4 | 1.81 kqf/25 mm |
| Recording Material No. 5 | 0.87 kgf/25 mm |
| Comparative Recording Material No. 1 | 0.30 kgf/25 mm |
| Comparative Recording Material No. 2 | 0.45 kgf/25 mm |

Further, the recording material according to the present invention did not cause the curling problem after 100 cycles of image formation and erasure were conducted.

Table 3 shows the change in the white opaque density of the reversible thermosensitive recording material when the cycle of image formation and erasure was repeated 100 times.

TABLE 3

| | White Opaque Density after 100 Cycles | Difference between Initial Image Density and Density after 100 cycles |
|---|---|---|
| Ex. 1 | 0.53 | 0.12 |
| Ex. 2 | 0.53 | 0.12 |
| Ex. 3 | 0.45 | 0.05 |
| Ex. 4 | 0.38 | 0.07 |
| Comp. Ex. 3 | 0.53 | 0.20 |

The reversible thermosensitive recording material according to the present invention has excellent durability and can produce images with high contrast. Moreover, in the recording material of the present invention, the curling problem can be prevented in the course of preparation thereof and after the repeated operations of image formation and erasure. In addition, the recording material of the present invention can be applied to an IC card without peeling problem of the films serving as a support even when the repetitious operations of the image formation and erasure were performed.

What is claimed is:

1. A reversible thermosensitive recording material comprising (i) a support which comprises a first polymeric film, an adhesive layer formed on said first polymeric film and a second polymeric film formed on said adhesive layer, with the adhesive strength between said first film and said second film being 1.0 kgf/25 mm or more in terms of the average tensile load at an angle of 180° measured in accordance with JIS K 6854, and (ii) a reversible thermosensitive recording layer formed on said second polymeric film, capable of reversible assuming a transparent state and a white opaque state depending on the temperature thereof, which recording layer comprises a matrix resin and an organic low-molecular-weight material dispersed in the form of finely-divided particles in said matrix resin, wherein said first polymeric film and said second polymeric film each have a thickness in the range of about 4 to 350 μm.

2. The reversible thermosensitive recording material as claimed in claim 1, wherein said adhesive layer comprises an adhesive agent which comprises at least one component selected from the group consisting of urea resin, melamine resin, phenolic resin, epoxy resin, vinyl acetate resin, vinyl acetate-acrylic copolymer resin, ethylene-vinyl acetate copolymer resin, acrylic resin, polyvinyl ether resin, vinyl chloride-vinyl acetate copolymer resin, polystyrene resin, polyester resin, polyurethane resin, polyamide resin, chlorinated polyolefin resin, polyvinyl butyral resin, acrylate copolymer resin, methacrylate copolymer resin, natural rubber, cyanoacrylate resin and silicone resin.

3. The reversible thermosensitive recording material as claimed in claim 2, wherein said adhesive layer further comprises a tackifier.

4. The reversible thermosensitive recording material as claimed in claim 3, wherein said adhesive layer further comprises at least one component selected from the group consisting of a plasticizer, a filler and a stabilizer.

5. The reversible thermosensitive recording material as claimed in claim 3, wherein the thickness of said adhesive layer is in the range of 1 to 40 $\mu$m.

6. The reversible thermosensitive recording material as claimed in claim 2, wherein said adhesive layer further comprises at least one component selected from the group consisting of a plasticizer, a filler and a stabilizer.

7. The reversible thermosensitive recording material as claimed in claim 2, wherein the thickness of said adhesive layer is in the range of 1 to 40 $\mu$m.

8. The reversible thermosensitive recording material as claimed in claim 1, wherein said first polymeric film and/or said second polymeric film comprises a plastic material selected from the group consisting of polyethylene, polypropylene, polyvinyl chloride, polyvinylidene chloride, polyvinyl alcohol, polyethylene terephthalate, polycarbonate, nylon, polystyrene, ethylene-vinyl acetate copolymer, ethylene-vinyl alcohol copolymer, polyethylene naphthalate, fluorinated ethylene propylene, aromatic polyamide, polyarylate, polyether sulfone, polyether imide, polyimide, acrylic resin and ionomer.

9. The reversible thermosensitive recording material as claimed in claim 1, further comprising a light reflection layer or colored layer which is interposed between said reversible thermosensitive recording layer and said second film.

10. A semiconductor device comprising the reversible thermosensitive recording material as claimed in claim 9 applied to an IC card functioning as an information-carrying member.

11. The reversible thermosensitive recording material as claimed in claim 1, further comprising a light reflection layer or colored layer which is interposed between said second film and said adhesive layer.

12. A semiconductor device comprising the reversible thermosensitive recording material as claimed in claim 11 applied to an IC card functioning as an information-carrying member.

13. The reversible thermosensitive recording material as claimed in claim 1, further comprising a light reflection layer or colored layer which is interposed between said adhesive layer and said first film.

14. A semiconductor device comprising the reversible thermosensitive recording material as claimed in claim 13 applied to an IC card functioning as an information-carrying member.

15. The reversible thermosensitive recording material as claimed in claim 1, wherein said adhesive layer between said first film and said second film includes a discontinuous portion in which said first film is out of contact with said second film.

16. The reversible thermosensitive recording material as claimed in claim 15, further comprising a light reflection layer or colored layer which is interposed between said adhesive layer and said first film.

17. A semiconductor device comprising the reversible thermosensitive recording material as claimed in claim 16 applied to an IC card functioning as an information-carrying member.

18. The reversible thermosensitive recording material as claimed in claim 15, wherein said first film is a colored film.

19. A semiconductor device comprising the reversible thermosensitive recording material as claimed in claim 15 applied to an IC card functioning as an information-carrying member.

20. The reversible thermosensitive recording material as claimed in claim 1, further comprising a magnetic recording layer which is interposed between said reversible thermosensitive recording layer and said second film.

21. The reversible thermosensitive recording material as claimed in claim 1, further comprising a magnetic recording layer which is interposed between said second film and said adhesive layer.

22. The reversible thermosensitive recording material as claimed in claim 1, further comprising a magnetic recording layer which is interposed between said adhesive layer and said first film.

23. The reversible thermosensitive recording material as claimed in claim 1, further comprising a magnetic recording layer which is provided on the back side of said first film opposite to said adhesive layer.

24. The reversible thermosensitive recording material as claimed in claim 1, further comprising a protective layer which is provided on said reversible thermosensitive recording layer.

25. The reversible thermosensitive recording material as claimed in claim 24, further comprising an intermediate layer which is interposed between said protective layer and said reversible thermosensitive recording layer.

26. A semiconductor device comprising the reversible thermosensitive recording material as claimed in claim 1 applied to an IC card functioning as an information-carrying member.

* * * * *

UNITED STATES PATENT AND TRADEMARK OFFICE

CERTIFICATE OF CORRECTION

PATENT NO. : 6,060,425

DATED : May 9, 2000

INVENTOR(S): Kunichika MOROHOSHI, et al.

It is certified that an error appears in the above-identified patent and that said Letters Patent is hereby corrected as shown below:

ON THE TITLE PAGE

Section [57], Abstract, "mateiral dispersed" should read --material dispersed--.

Column 1, line 61, "above-mention ed" should read --above-mentioned--.

Signed and Sealed this

Eighth Day of May, 2001

*Attest:*

Nicholas P. Godici

NICHOLAS P. GODICI

*Attesting Officer*

*Acting Director of the United States Patent and Trademark Office*